US006286490B1

(12) United States Patent
Koelter

(10) Patent No.: US 6,286,490 B1
(45) Date of Patent: Sep. 11, 2001

(54) IGNITION SYSTEM FOR AN INTERNAL COMBUSTION ENGINE

(75) Inventor: Martin Koelter, Eichenau (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/438,315

(22) Filed: Nov. 12, 1999

(30) Foreign Application Priority Data

Nov. 12, 1998 (DE) ..... 198 52 295

(51) Int. Cl.[7] ..... F02P 15/00
(52) U.S. Cl. ..... 123/635; 123/169 PA
(58) Field of Search ..... 123/143 C, 169 PA, 123/635; 439/125, 126

(56) References Cited

U.S. PATENT DOCUMENTS 5,537,983 * 7/1996 Nakajima ..... 123/635
5,618,193 * 4/1997 Nakajima et al. ..... 123/169 PA X

FOREIGN PATENT DOCUMENTS 19624287 4/1997 (DE) .
29614873 2/1998 (DE) .
09-126112 * 5/1997 (JP) .
09-126113 * 5/1997 (JP) .
WO85/00930 2/1985 (WO) .

* cited by examiner

*Primary Examiner*—Tony M. Argenbright
(74) *Attorney, Agent, or Firm*—Crowell & Moring LLP

(57) ABSTRACT

In an ignition system for an internal combustion engine, with at least one spark plug/ignition coil unit inserted into a spark plug shaft of the cylinder head of an internal combustion engine, said unit being connected by electrical leads with the vehicle electrical system, a sealing body is located between the unit and the mounting opening, said body holding the ignition coil so that it does not rotate and in turn being held nonrotatably in the mounting opening. The sealing body is a molded body of elastic material.

12 Claims, 1 Drawing Sheet

IGNITION SYSTEM FOR AN INTERNAL COMBUSTION ENGINE

BACKGROUND AND SUMMARY OF THE INVENTION

This application claims the priority of German application 198 82 295.9, filed in Germany on Nov. 12, 1998, the disclosure of which is expressly incorporated by reference herein.

The invention relates to an ignition system for an internal combustion engine with at least one spark plug/ignition coil unit inserted into a spark plug shaft of a cylinder head of an internal combustion engine, said unit being connected by electrical leads with the vehicle electrical system.

An ignition system of this kind is known in principle from German Patent Document DE 297 01 235 U. In this document the problem is solved of sealing off the spark plug from the exterior when the spark plug/ignition coil unit located in the cylinder head is provided with a high-voltage lead that passes through the mounting opening of a valve cover placed on the cylinder head. In the known ignition system, a sealing body is provided between the mounting opening and the unit.

However, this exacerbates a problem that generally exists in such an arrangement of a spark plug/coil unit in the cylinder head. Mechanical vibration can cause the ignition coil to rotate relative to the spark plug as the engine operates. This results in a considerable mechanical stress on the electrical lead which in extreme cases can even result in destruction of the lead and hence in complete inoperability of the ignition system, at least for the individual cylinder.

One way of eliminating this problem is to provide a rotary safety device between the ignition core and the spark plug. However, this means considerable structural expense since the connection between the ignition coil and the spark plug is not determined by their relative rotational positions with respect to one another.

A goal of the invention is to provide an ignition system of the type referred to at the outset in which the risk of damaging the electrical connection between the spark plug and ignition coil unit is eliminated in a fashion that employs a simple design.

The invention achieves this goal by providing an ignition system of the type referred to above, wherein a sealing body is located between the coil unit and a mounting opening, said sealing body holding the ignition coil so that it does not rotate and in turn it is held nonrotatably in the mounting opening.

The molded body, which preferably consists of an elastic material, serves primarily to secure the rotational position of the ignition coil. This eliminates a particular mechanical stress on the electrical lead of the ignition coil. It is not necessary to have any kind of rigid mechanical connection between the ignition coil and the spark plug. The correct rotational position of the ignition coil can be achieved by providing an appropriate shape for the molded body. For example, it is sufficient to have a simple marking which corresponds for example with a reference marking on the edge of the mounting opening when the ignition coil is in the correct rotational position.

A design improvement to the invention consists in providing the molded body with an extension that projects over the cross section of the mounting opening and engages a recess. By shaping the ignition coil, it is thus possible for the molded body to fit into the recess when the ignition coil is correctly mounted. The correct seating of the molded body and hence of the ignition coil can thus be recognized easily.

In the known ignition system, ventilation openings are provided inside the sealing body through which the gas volume in the vicinity of the spark plug "breathes". This poses the particular problem of protection against spray. The entrainment of moisture is also associated with the air flow, with the consequential penetration of moisture into the vicinity of the spark plug. On the other hand, a considerable improvement is achieved when a ventilation labyrinth is located inside the molded body. In this way, any moisture that accumulates is shed and the air that may be introduced into the vicinity of the spark plug is free of water drops.

Other objects, advantages and novel features of the present invention will become apparent from the following detailed description of the invention when considered in conjunction with the accompanying drawings.

DETAILED DESCRIPTION OF THE DRAWINGS

Figure 1:
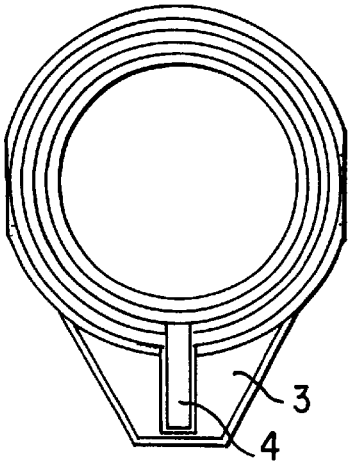
FIG. 1 shows a molded body according to the invention in a top view.
Figure 2:
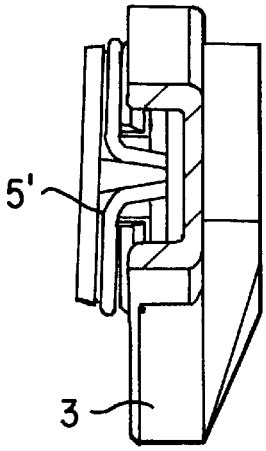
FIG. 2 shows the molded body of FIG. 1 in a side view.
Figure 3:
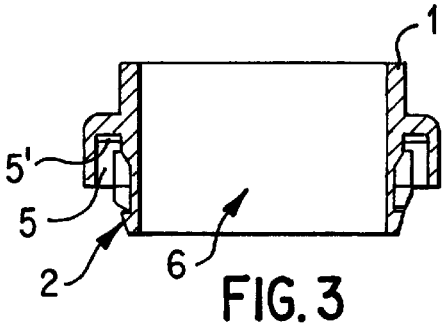
FIG. 3 shows the molded body of FIG. 1 in cross section.

The molded body 1 shown in FIGS. 1 to 3 consists of an elastic material, silicone for example. It is located between a mounting opening (not shown) of the cylinder head of an internal combustion engine and an ignition coil (likewise not shown) which is part of an ignition coil/spark plug unit (so-called single coil ignition system). Molded body 1 consists primarily of a portion 2 in the form of a cylindrical tube and is provided with an extension 3 which engages by a groove 4 in a recess at the edge of the spark plug shaft 6 (not shown).

Molded body 1 also has sealing labyrinth 5 which has the shape of a closed round channel 5' and extends almost completely around the circumference of cylindrical tube 2. On the circumference, closely adjacent, labyrinth 5 has an inlet and an outlet opening. Air passes through the inlet opening into the sealing labyrinth 5 and this air passes through the outlet opening into the interior of spark plug shaft 6. Droplets of moisture suspended in the air are separated in round channel 5' and therefore do not reach the interior of spark plug shaft 6.

The ignition coil has its rotational position secured relative to molded body 1. For this purpose, for example, it has a groove into which a matching recess, in the shape of a rib for example, on molded body 1 engages.

As a result of the rotational position of molded body 1 being secured relative to the mounting opening/spark plug shaft 6 and the ignition coil having its rotational position secured relative to molded body 1, an arrangement of the ignition coil within the mounting opening 2 whose rotational position is secured is achieved. The electrical leads of the ignition coil therefore are not subject to any particular mechanical stress, even during long-term operation. The ignition coil is merely inserted and held in place exclusively by friction, aided by the elastic material of which the molded body is made. The molded body shown, because of its material and its shape, can accept height tolerances up to 2 mm while retaining the labyrinth and its sealing function. At the same time, the coil is decoupled from vibration, since there is no direct connection between the coil and the cylinder head of the internal combustion engine.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Ignition system of an internal combustion engine with at least one spark plug/ignition coil unit inserted into a spark plug shaft of a cylinder head of an internal combustion engine, said unit being connected by electrical leads with the vehicle electrical system, wherein a sealing body is located between the coil unit and a mounting opening, said sealing body holding the ignition coil so that it does not rotate and is in turn held nonrotatably in the mounting opening.

2. Ignition system according to claim 1, wherein the sealing body has an extension which projects over a cross section of the mounting opening and engages a recess.

3. Ignition system according to claim 1, wherein a ventilation labyrinth is located inside the sealing body.

4. Ignition system according to claim 2, wherein a ventilation labyrinth is located inside the sealing body.

5. Ignition system according to claim 1, wherein said sealing body is a molded body of elastic material.

6. Ignition system according to claim 2, wherein said sealing body is a molded body of elastic material.

7. Ignition system according to claim 3, wherein said sealing body is a molded body of elastic material.

8. Ignition system according to claim 4, wherein said sealing body is a molded body of elastic material.

9. A sealing body for an ignition system of an internal combustion engine which has at least one spark plug/ignition coil unit inserted in use into a spark plug shaft of an engine cylinder head, said sealing body being a molded elastic body which in use is located between the coil unit and a mounting opening, said sealing body holding the ignition coil so that it does not rotate and is in turn held nonrotatably in the mounting opening.

10. A sealing body according to claim 9, wherein the sealing body has an extension which projects over a cross section of the mounting opening and engages a recess.

11. A sealing body according to claim 9, wherein a ventilation labyrinth is located inside the sealing body.

12. A sealing body according to claim 10, wherein a ventilation labyrinth is located inside the sealing body.

* * * * *